US006367534B1

(12) United States Patent
McGlenn

(10) Patent No.: US 6,367,534 B1
(45) Date of Patent: Apr. 9, 2002

(54) PUMP FILLED DRYWALL TAPING MACHINES

(76) Inventor: Scott J McGlenn, 2400 W. 34th Ave., Ancorage, AK (US) 99517

( * ) Notice: Subject to any disclaimer, the term of this patent is extended or adjusted under 35 U.S.C. 154(b) by 0 days.

(21) Appl. No.: 09/489,522

(22) Filed: Jan. 21, 2000

(51) Int. Cl.[7] ..... B44C 7/02

(52) U.S. Cl. ..... 156/575; 156/574; 156/577; 156/579; 156/524; 118/405; 118/413; 52/749.1

(58) Field of Search ..... 156/575, 574, 156/577, 579, 523, 524; 52/749.1; 118/465, 43, 123, 413

(56) References Cited

U.S. PATENT DOCUMENTS 4,196,028 A * 4/1980 Mills et al. ..... 156/71
5,114,527 A * 5/1992 Stern et al. ..... 156/575
5,242,495 A * 9/1993 Hammond et al. ..... 118/43
5,736,001 A * 4/1998 Samuelson ..... 156/575
5,878,921 A * 3/1999 Chase et al. ..... 222/333
5,882,691 A * 3/1999 Conboy ..... 425/87

* cited by examiner

*Primary Examiner*—Robert Canfield
(74) *Attorney, Agent, or Firm*—Michael J. Tavella

(57) ABSTRACT

An improvement to a corner-box drywall taping tool. It uses a housing similar to the existing tools. This housing has a quick release spring-loaded one-way valve attached to the mud area of the tool. One a roll of tape is installed; the unit is attached to a mud pump by the quick release fitting. A pump then fills the housing with mud in about 20 seconds. To prevent the case from opening under the pressure of the pump, additional latches are required to seal the housing. When the mud is exhausted with this device, the operator returns to the mud pump, attaches the fitting to the pump and in another 20 seconds is ready to go. This process can be repeated until the tape supply is exhausted. In this way, the device saves a lot of time during the filling process.

15 Claims, 4 Drawing Sheets

PUMP FILLED DRYWALL TAPING MACHINES

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to drywall taping machines and particularly drywall taping machines having pump filling systems.

2. Description of Related Art

The use of drywall for wall systems has replaced plaster as the most common wallboard treatment. Drywall, or sheet rock, is a product that comes in large flat sheets. These sheets are attached to wall studs to make up the interior walls in buildings and homes. When these sheets are installed, seams are formed between sheets. Typically, these seams must be covered and sealed. Industry practice uses a special tape to seal these seams. The tape is actually a perforated roll of paper that is embedded against the seam with joint compound, which is typically called "mud". Although the tape and mud can be installed by hand, taping machines have been developed to make this process easier and faster. These machines typically have a housing that holds a quantity of tape and mud. The machine has a dispensing end from which the tape is removed. As the tape passes through the housing, mud is applied. Thus, when the tape is removed, there is a quantity of mud on it. This makes installing the tape go much faster. Examples of these devices are found in U.S. Pat. Nos. 4,196,028, 5,789,343, 5,114,527, 5,676,793, 4,996,941, 4,652,331, 4,452,663, 4,080,240, 4,003,781, 3,112,225, and 2,366,675.

BRIEF SUMMARY OF THE INVENTION

The instant invention improves one of these machines by making its set-up go faster and easier. This machine is known in the industry as a "banjo". When loading a typical banjo, the housing is opened, the roll of tape is secured in the machine, the end of the tape is pulled through the dispenser and the body of the device is then filled with mud. The housing is then closed and the tool is ready to use. Typically, the tools can hold much more tape than mud. When the initial load of mud is exhausted, the operator must return to the mud bucket, lay the tool down flat, open the tool door and hand trowel a new load of mud. The door is then closed and the latches are secured. The tool is then again ready for use. At best, this process may take a few minutes. At worst, the process may take five to ten minutes.

The instant invention eliminates much of the labor in filling a banjo-type taping tool. It uses a housing similar to the existing tools. This housing has a quick release spring-loaded one-way valve attached to the mud area of the tool. This tool is used by opening the door and placing the tape as before. The door is then closed. The tape is held in place at the dispenser by a clamp. The unit is then attached to a mud pump that attached to the quick release fitting. A pump then fills the housing with mud in about 20 seconds. To prevent the case from opening under the pressure of the pump, additional latches are required to seal the housing. When the mud is exhausted with this device, the operator returns to the mud pump, attaches the fitting to the pump and in another 20 seconds is ready to go. This process can be repeated until the tape supply is exhausted. In this way, the device saves a lot of time during the filling process.

DETAILED DESCRIPTION OF THE INVENTION

Figure 1:
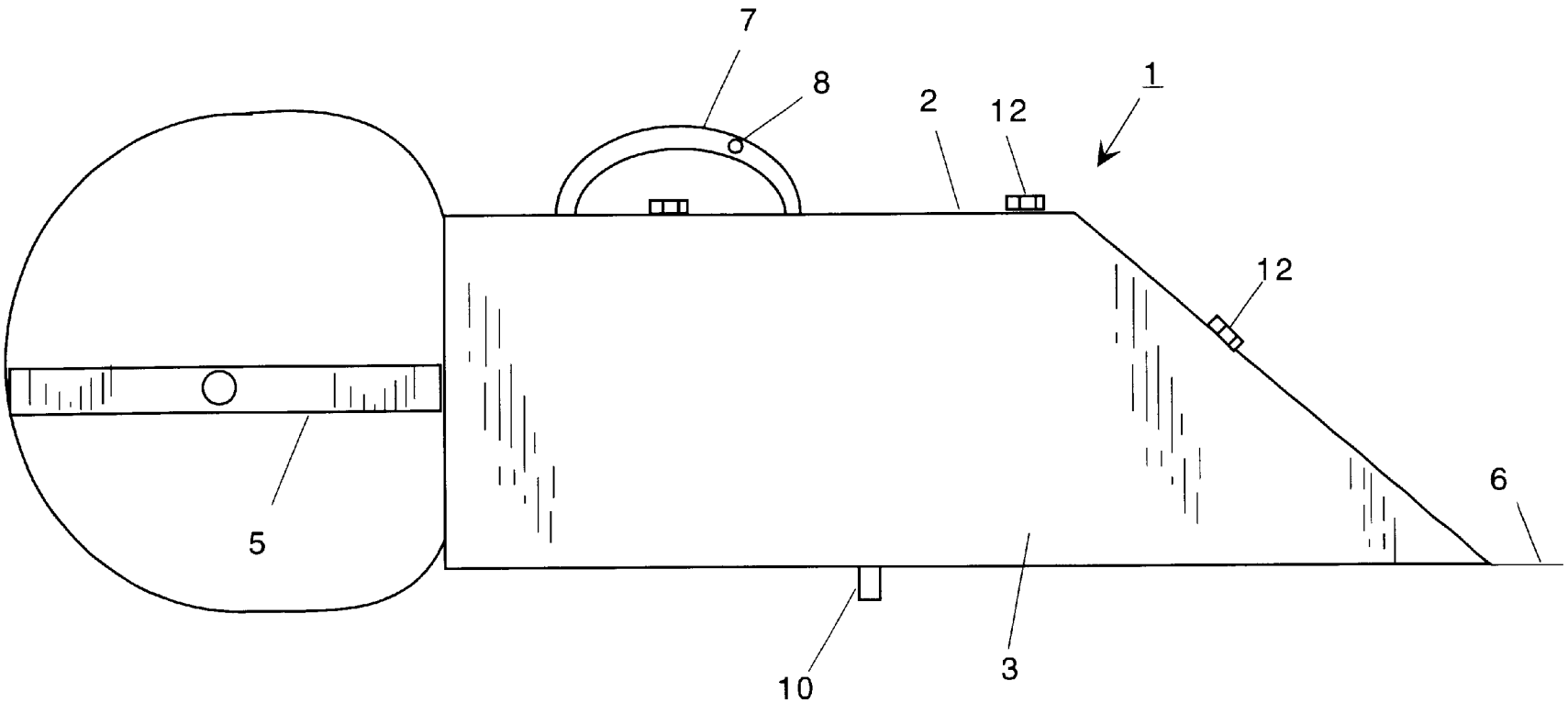
FIG. 1 is a side view of the invention.

Referring now to FIG. 1, the modified banjo tool 1 is shown. This tool has a housing 2 that has a removable lid 3 (see FIG. 2). At one end of the tool is a bracket 5 that supports a roll of drywall tape. At the other end of the housing is a tape dispenser 6. A handle 7 is attached for the convenience of the user. A spring type one-way valve 10 is attached to the bottom of the housing as shown. This valve is used to fill the interior of the box 11 (see FIG. 2) with drywall compound. Unlike the traditional method of filling, however, the door does not have to be removed. The filling procedure is discussed below.

Figure 2:
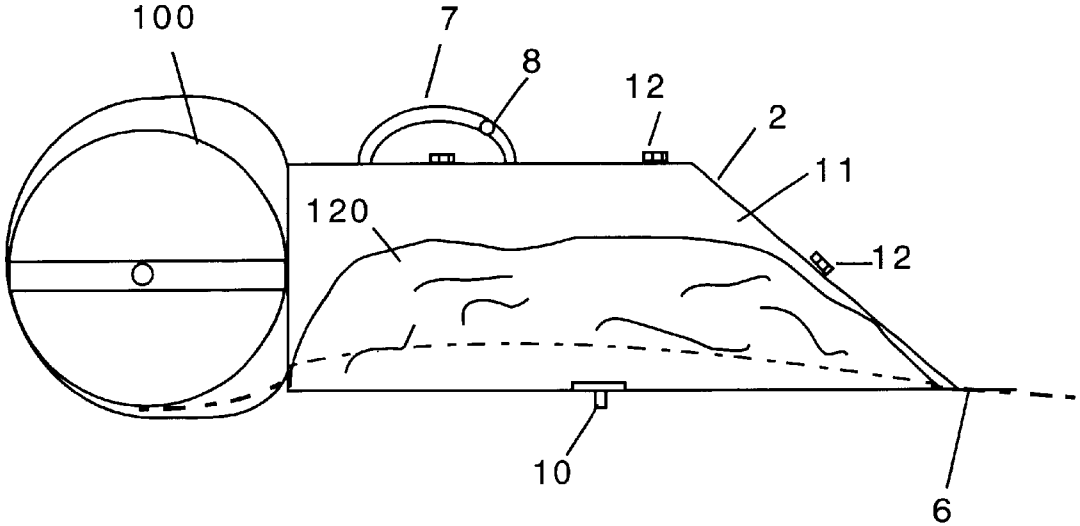
FIG. 2 is a side detail view of the device showing the side door removed and a roll of tape installed.
Figure 2:
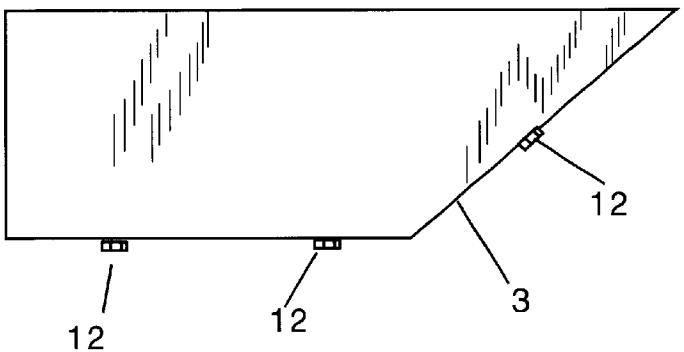

FIG. 2 shows the tool with the door removed. Tape 100 is secured in the tape bracket 5. It then passes into and through the housing 2, which is filled with mud 120, until it comes to the dispenser 6. When the tape is removed from the dispenser, it is ready to be applied immediately to a seam. Once the tape has been secured to the wallboard, the seam is finished by pulling the tool along the seam.

Figure 3:
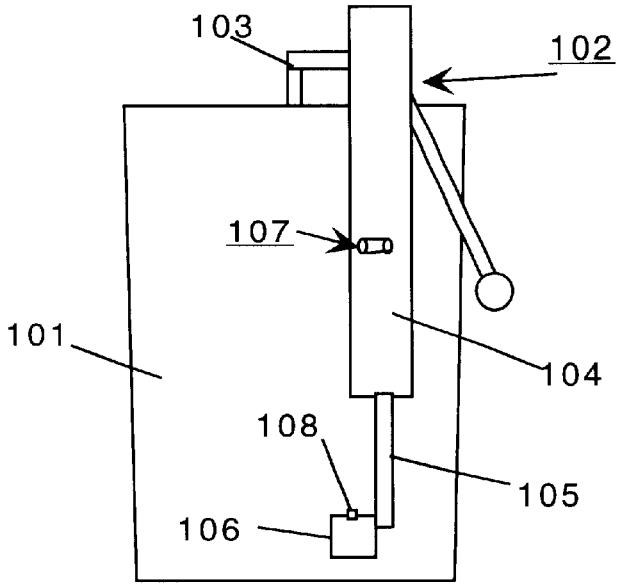
FIG. 3 is a detail view of a typical mud pump system installed in a bucket of drywall compound.
Figure 3A:
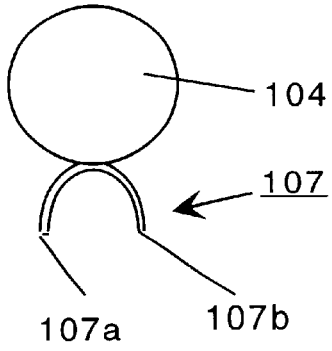
FIG. 3*a* is a top detail view of a pump gooseneck bracket.

As noted above, there is often much more tape than mud in the tool. When the mud is exhausted from the device, the device can be quickly refilled. FIG. 3 shows a bucket of drywall compound 101 that has a pump system 102 installed. The pump has an inlet line 103 that is placed into the bucket. The pump has a pumping mechanism 104 that attaches to an outlet line 105 and an outlet fitting 106. This outlet fitting 106 has a mating plug 108 that attaches to the valve 10 on the tool. The pumps also have a gooseneck fitting 107 that has two prongs 107*a* and 107*b*. See FIG. 3*a*. Normally a larger device, such as a bazooka is secured between the two prongs. However, the instant invention uses one of the prongs to help hold the tool in place.

Figure 4:
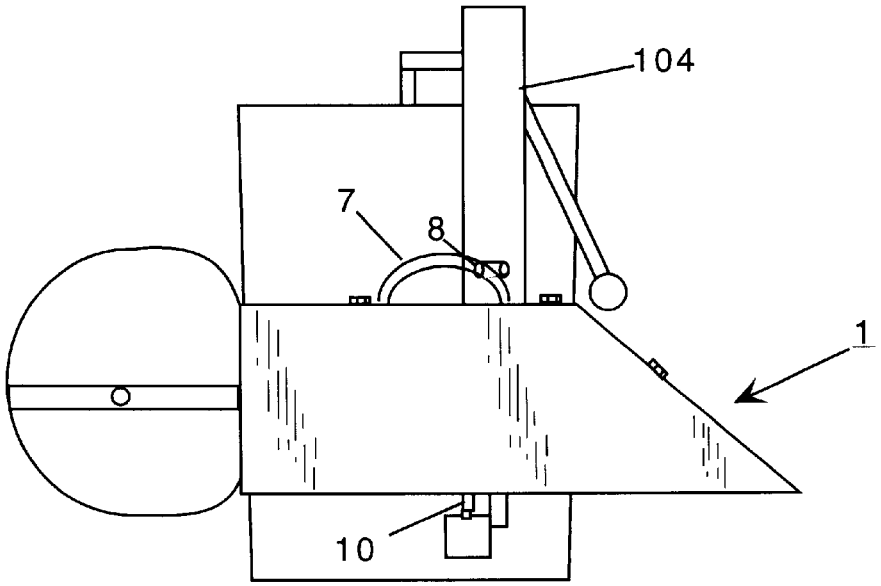
FIG. 4 is a detail view of the device installed on the filling nozzle of the mud pump, ready for filling with drywall compound.

FIG. 4 shows the tool in place on the mating plug 108. As discussed above, the tool is placed on the mating plug 108 and the handle 7 is then pushed against on of the prongs of the gooseneck to hold the device steady. A hole 8 is provided in the handle 7 to secure the handle to one of the prongs as shown in FIG. 4. Once the device is in place on the mating plug, the housing can be filled by either hand pumping or by pumping with a small electric pump. There is no need to open or remove the door. A typical pump can fill the housing with compound in about 20–30 seconds. Once the housing is filled, the device is removed from the mating plug and is then ready for use.

As shown in FIGS. 1 and 2, a number of latches 12 are placed around the perimeter of the housing 2 and door 3. Unlike the ordinary banjo tool that may use one or two latches, the instant invention has several latches. These latches prevent the door 2 from being pushed open by the force of the mud as it fills the housing. One or two latches are not enough to hold the door closed. Normally, this is not a problem because the door is opened for hand filling with the typical banjo tool. Thus, only one or two latches are needed to hold the door closed. Here, the additional latches are needed.

Figure 5:
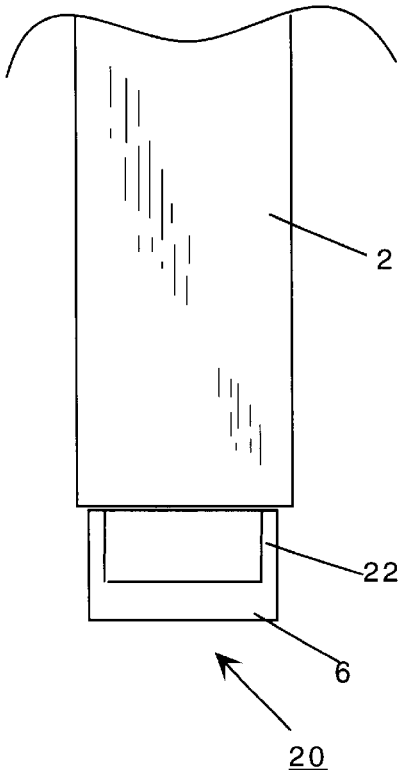
FIG. 5 is a top detail view of the tape clamp, attached to the front end of the device.
Figure 6:
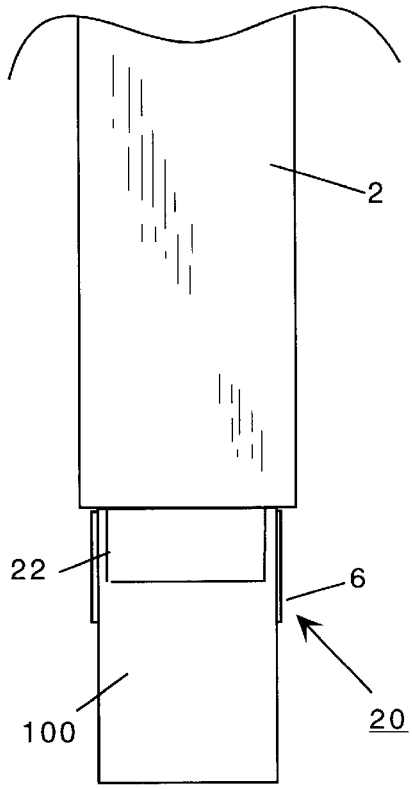
FIG. 6 is a top detail view of the tape clamp, attached to the front end of the device, with a length of tape being held by the clamp.

To prevent the tape from being pulled back into the housing during filling (which then requires the housing to be opened, which defeats the purpose of the valve); a clamp 20 is attached to the dispensing end of the housing. The clamp 20 has a base plate 6, which is actually the cutoff blade in a typical banjo, and a spring arm 22 that is fastened above the base plate 6 as shown. FIG. 5 shows the clamp 20. FIG. 6 shows a length of tape 100 being held in the clamp 20.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A tool for applying drywall tape and drywall compound comprising:

a) a housing, said housing having an open interior;

b) a drywall compound compartment formed in said open interior of said housing;

c) a door, removably attached to said housing, said door having a perimeter;

d) a means for securing said door to said housing;

e) a one-way valve, attached to said housing and in communication with said drywall compound compartment, said one-way valve being configured to deposit a quantity of drywall compound from outside of said housing into the open interior of said housing;

f) a tape outlet, formed on said housing; and g) a means for securing a length of drywall tape, operably attached to said tape outlet.

2. The tool of claim 1 wherein the means for securing said door to said housing comprise a plurality of latches.

3. The tool of claim 2 wherein the plurality of latches is spaced about the perimeter of said door.

4. The tool of claim 1 wherein the means for securing a length of drywall tape comprises:

a) a base plate, fixedly attached to said housing; and b) a spring clip, attached to said housing such that said spring clip is in operable contact with said base plate.

5. The tool of claim 1 further comprising: a handle attached to said housing; whereby said handle having an alignment hole formed therein for receiving a prong from a drywall pump gooseneck support bracket.

6. The tool of claim 1 further comprising a means for filling said drywall compound compartment, being removably attached to said one-way valve.

7. The tool of claim 6 wherein said means for filling said drywall compound compartment comprises a hand pump.

8. The tool of claim 6 wherein said means for filling said drywall compound compartment comprises an electric pump.

9. A drywall-taping tool having a housing, a removable door, having a perimeter, a drywall compound compartment formed in said housing, and a tape outlet, attached to said housing, wherein the improvement comprises:

a) a plurality of latches, operably attached to said housing such that said removable door is securely attached to said housing when said plurality of latches is engaged;

b) a one way valve, attached to said housing and in communication with said drywall compound compartment, said one-way valve being configured to deposit a quantity of drywall compound from outside of said housing into the open interior of said housing; and c) a means for securing a length of drywall tape, operably attached to said tape outlet.

10. The drywall-taping tool of claim 9 wherein the plurality of latches is spaced about the perimeter of said removable door.

11. The drywall-taping tool of claim 9 wherein the means for securing a length of drywall tape comprises:

a) a base plate, fixedly attached to said housing; and b) a spring clip, attached to said housing such that said spring clip is in operable contact with said base plate.

12. The tool of claim 9 further comprising: a handle attached to said housing; whereby said handle having an alignment hole formed therein for receiving a prong from a drywall pump gooseneck support bracket.

13. The drywall-taping tool of claim 9 further comprising a means for filling said drywall compound compartment, being removably attached to said one-way valve.

14. The drywall-taping tool of claim 13 wherein said means for filling said drywall compound compartment comprises a hand pump.

15. The drywall-taping tool of claim 13 wherein said means for filling said drywall compound compartment comprises an electric pump.

* * * * *